US005735680A

United States Patent [19]

Henkelmann

[11] Patent Number: 5,735,680

[45] **Date of Patent: *Apr. 7, 1998**

[54] FUME INCINERATION

[75] Inventor: Gary Henkelmann, Elgin, Ill.

[73] Assignee: Applied Web Systems, Inc., Elgin, Ill.

[ * ] Notice: The term of this patent shall not extend beyond the expiration date of Pat. No. 5,643,544.

[21] Appl. No.: 816,667

[22] Filed: Mar. 13, 1997

[51] Int. Cl.[6] ..... F23G 7/06; F23J 15/00; F01N 3/10

[52] U.S. Cl. ..... 431/5; 431/11; 431/215; 422/173; 422/183; 422/201; 422/205; 423/245.3; 122/511

[58] Field of Search ..... 422/168, 173, 422/198, 175, 177, 171, 182–183, 200, 205, 201, 227, 234; 431/5, 7, 11, 215, 166; 423/245.3; 122/511

[56] References Cited

U.S. PATENT DOCUMENTS

| | | | |
|---|---|---|---|
| 3,898,040 | 8/1975 | Tabak | 431/5 |
| 4,444,735 | 4/1984 | Birmingham et al. | 422/173 |
| 5,200,155 | 4/1993 | Obermueller | 422/173 |
| 5,376,340 | 12/1994 | Bayer et al. | 422/175 |
| 5,643,544 | 7/1997 | Henkelmann | 422/183 |

*Primary Examiner*—Hien Tran
*Attorney, Agent, or Firm*—Douglas B. White

[57] ABSTRACT

This incinerator circulates fumes to be incinerated through a heat exchange chamber; feeds the fumes into a combustion chamber; directs the incinerated fumes through heat exchange tubes to heat incoming fumes; scavenges fume leakage; and recirculates the scavenged fumes for incineration. Leakage of unincinerated fumes is controlled by use of a plurality of scavenging tubes positioned such that their orifices are proximate the hot end tube sheet within the combustion chamber to collect leaking fumes found near the hot end tube sheet and to feed those fumes back to the inlet for incineration.

19 Claims, 2 Drawing Sheets

FUME INCINERATION

BACKGROUND OF THE INVENTION

1. Field of the Invention

The present invention relates generally to a fume incinerator of the type employing a heat exchanger to recoup heat from the outgoing incinerated gas. More particularly, this invention relates to means for scavenging leaking fumes to thereby improve the effectiveness of the incinerator.

2. Description of the Prior Art

Prior art fume incinerators employing a heat exchange system typically use heat exchange tubes to carry incinerated gas from a combustion chamber. Incoming fumes are circulated around the tubes and are thereby preheated by outgoing incinerated gas. Such a heat recovery system is well known to increase the efficiency of this type of pollution control device and has been the subject of a number of prior art patents. (See for example U.S. Pat. Nos. 3,806,322; 5,200,155; and 4,444,735.) A more effective version of such a heat recovery system is shown in my co-pending application for U.S. Pat., Ser. No. 08/430,376, the disclosure therein being hereby incorporated by reference. In that apparatus, heat exchange tubes are employed to pass hot incinerated gas from a combustion chamber to the incinerator outlet, and incoming fumes are circulated over the outgoing tubes before entering the combustion chamber. These heat exchange tubes are rigidly mounted at their cold end, and are loosely mounted at their hot end (adjoining the combustion chamber). The hot end tube mounting sheet employs mounting openings slightly larger than the tube diameters to loosely hold the tubes in place while allowing for expansion and contraction. With this arrangement, some incoming fumes have been found to leak through the hot end tube sheet; however, by extending the heat exchange tubes well into the combustion chamber, the effect of this leakage has been considerably reduced, but not eliminated.

SUMMARY OF THE INVENTION

Accordingly, it is the objective of this invention to provide further means to control the leakage of unincinerated fumes. Specifically, this method of fume incineration includes circulating fumes to be incinerated through a heat exchange chamber; passing the fumes into a combustion chamber; directing the incinerated fumes back through the heat exchanger to heat the incoming fumes; scavenging fume leakage by means of scavenging tubes strategically mounted through the heat exchange chamber; and finally recirculating the scavenged fumes for incineration. This is accomplished in the preferred embodiment by positioning a plurality of scavenging tubes through the heat exchange chamber with their orifices proximate the hot end tube sheet. These tubes collect leaking fumes found near the hot end tube sheet and feed the fumes back to the inlet for incineration.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
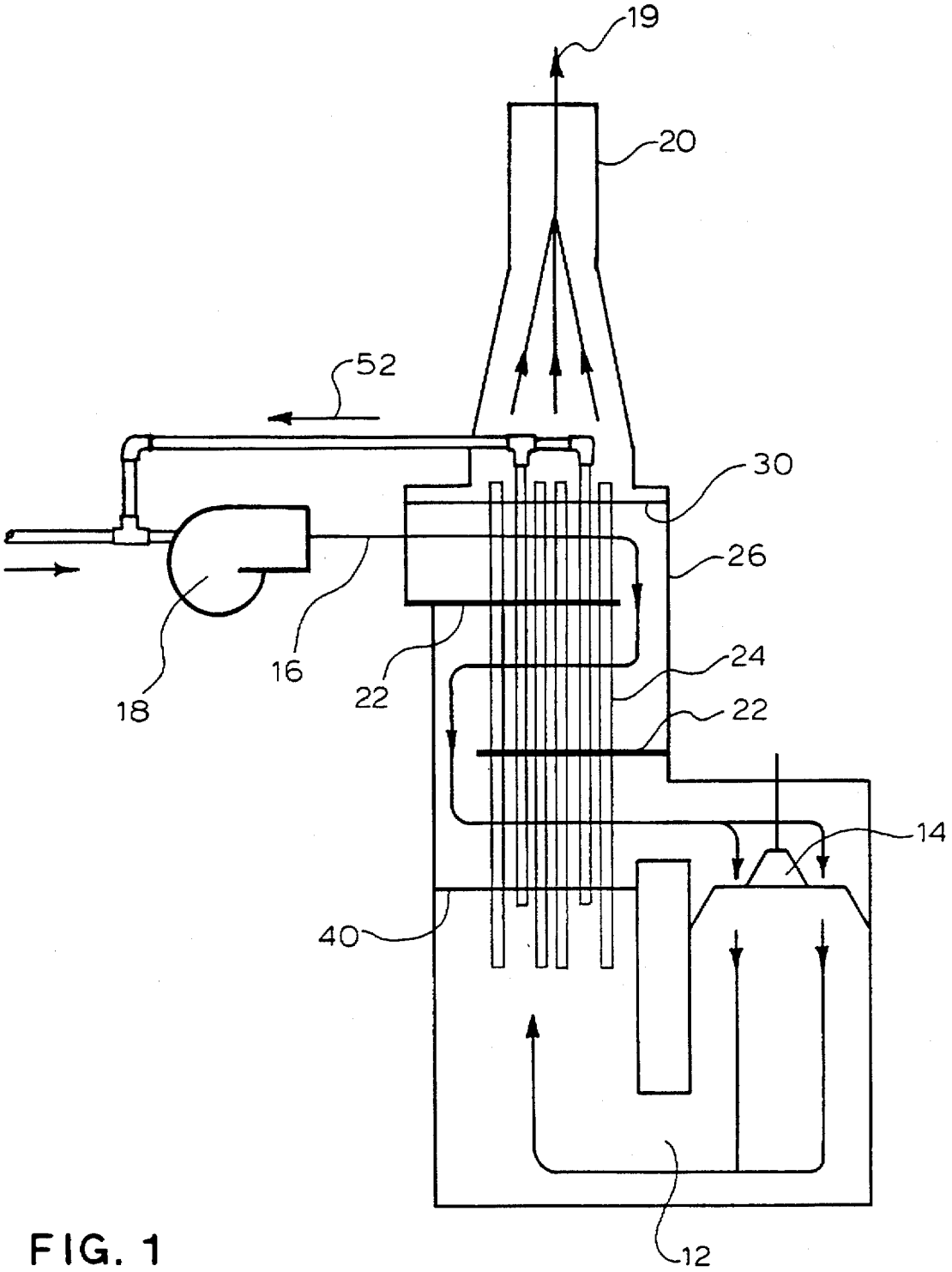
FIG. 1 is a diagrammatic view of an incinerator in accordance with this invention.

Turning first to FIG. 1 there is shown a diagrammatic view of an incinerator in accordance with the present invention. This incinerator is an improvement on the apparatus presented in my copending application for U.S. Patent, Ser. No. 08/430,376, and that disclosure is accordingly incorporated herein by reference. Fume incineration in accordance with the method and apparatus described is accomplished within a vessel by means of a combustion chamber 12 in which fumes are incinerated in the heat generated from a burner assembly 14. Noxious fumes 16 enter the incinerator through a blower fan 18 and incinerated gas 19 exits the incinerator via the outlet stack 20. After pre-heating in a heat exchange chamber the fumes are delivered to the combustion chamber through a communicating passage at the burner assembly 14.

The heat exchange chamber of this incinerator is used to increase the efficiency of the incinerator and involves circulating the incoming fumes 16 around baffles 22 and heat exchange tubes 24 which carry the outgoing hot incinerated gas. The heat exchange tubes 24 are mounted within the containing vessel 26 by means of tube sheets which also serve to contain the fumes and to define the heat exchange chamber.

At the cold end of the heat exchange tubes, near the incinerator outlet, the tubes are rigidly mounted to a mounting member 30 commonly known as a tube sheet. This tube sheet is shaped and fitted to the vessel and the tubes are secured therein to provide a mounting structure which seals the vessel to prevent incoming fumes from leaking into the incinerator outlet 20.

At the hot end of the heat exchange tubes, near the incinerator combustion chamber 12, the tubes are loosely mounted within a mounting member 40, the hot end tube sheet. This hot end tube sheet 40 is similarly shaped to conform to the vessel, to seal around its perimeter 42 (FIG. 2), but each of the tubes mounted therein are loosely contained by the hot end tube sheet to allow for expansion and contraction. As a result, the gap 44 between each tube and the respective orifice 46 in the hot end tube sheet 40 allows some of the incoming fumes **16*a*** to leak through to the combustion chamber side of the hot end tube sheet.

Figure 2:
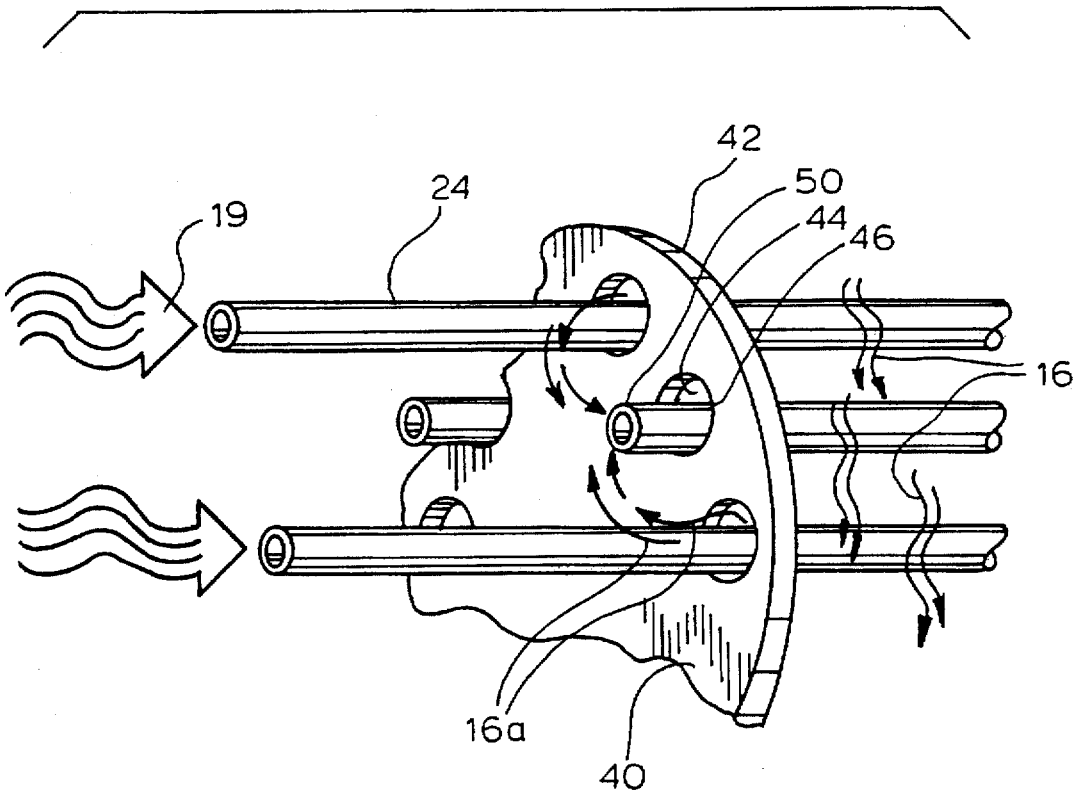
FIG. 2 is a perspective pictorial view of the hot end tube sheet of the incinerator of FIG. 1.

To remove the aforesaid fume leakage, a plurality of shortened scavenging tubes 50 are provided, having their inlet orifices near the hot end tube sheet. As shown in FIG. 1, these shortened tubes 50 extend through the heat exchange chamber and into the combustion chamber, but they enter into the combustion chamber a distance less than that of the heat exchange tubes 24. At the cold end, of the heat exchange chamber, the scavenging tubes are connected to the inlet of the blower fan 18. This connection creates a suction effect near the hot end tube sheet in the vicinity of the shortened tubes to scavenge leaking fumes **16*a*, as depicted in FIG. 2, and to redirect these fumes to the incinerator inlet. (The direction of the redirected fumes is illustrated by the arrow 52**.)

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. A fume incinerator comprising:

a combustion chamber including burner means therein;

a heat exchange chamber adjacent to said combustion chamber, said heat exchange chamber having a fume inlet and having passage means for delivering fumes from said heat exchange chamber to said combustion chamber, whereby fumes enter said fume inlet and pass through said heat exchange chamber before entering said combustion chamber for incineration;

a hot end tube mounting means positioned at one end of said heat exchange chamber adjacent to said combustion chamber;

a cold end tube mounting means positioned at the opposing end of said heat exchange chamber;

a plurality of heat exchange tubes, each mounted at one end in said cold end tube mounting means and at its other end in said hot end tube mounting means, said heat exchange tubes extending through said hot end tube mounting means into said combustion chamber, wherein said heat exchange tubes transport incinerated gas from said combustion chamber through said heat exchange chamber; and scavenging means for evacuating fumes proximate said hot end tube mounting means and for recirculating said evacuated fumes into said fume inlet.

2. The fume incinerator of claim 1 wherein said scavenging means comprises a plurality of scavenging tubes.

3. The fume incinerator of claim 2 wherein said scavenging tubes are each mounted at one end in said cold end tube mounting means and at its other end in said hot end tube mounting means.

4. The fume incinerator of claim 3 wherein said scavenging tubes extend through said hot end tube mounting means into said combustion chamber and define orifices spaced from said hot end tube mounting means.

5. The fume incinerator of claim 4 wherein said heat exchange tubes extend further into said combustion chamber than said scavenging tubes extend into said combustion chamber.

6. The fume incinerator of claim 3 wherein said scavenging tubes are connected to said fume inlet.

7. The fume incinerator of claim 6 further comprising fan means to deliver fumes to said fume inlet.

8. The fume incinerator of claim 7 wherein said scavenging tubes are connected to an inlet of said fan means.

9. The fume incinerator of claim 1 wherein said hot end tube mounting means comprises a tube sheet arranged to loosely hold the heat exchange tubes mounted therein.

10. The fume incinerator of claim 9 wherein said scavenging means comprises a plurality of scavenging tubes each mounted at one end in said cold end tube mounting means and mounted at its other end in said hot end tube sheet.

11. The fume incinerator of claim 10 wherein said scavenging tubes extend through said hot end tube sheet into said combustion chamber and define an orifice spaced from said hot end tube sheet.

12. The fume incinerator of claim 11 wherein said heat exchange tubes extend further into said combustion chamber than said scavenging tubes extend into said combustion chamber.

13. The fume incinerator of claim 12 further comprising fan means to deliver fumes to said fume inlet.

14. The fume incinerator of claim 13 wherein said scavenging tubes are connected to an inlet of said fan means.

15. A method of efficient fume incineration comprising:

passing incoming fumes to be incinerated from a fume inlet through a heat exchange chamber for pre-heating;

passing said pre-heated fumes into a combustion chamber having burner means therein for incinerating said fumes;

directing said incinerated fumes through said heat exchange chamber to thereby heat incoming fumes;

scavenging fumes leaking into said combustion chamber; and recirculating said scavenged fumes to said fume inlet for incineration.

16. The method of efficient fume incineration of claim 15 wherein the step of scavenging fumes further comprises the step of connecting scavenging tubes from said combustion chamber to said fume inlet.

17. The method of efficient fume incineration of claim 16 wherein said scavenging tubes are mounted to extend through said heat exchange chamber into said combustion chamber.

18. The method of efficient fume incineration of claim 17 further comprising the step of first employing fan means to supply fumes under pressure to said fume inlet.

19. The method of efficient fume incineration of claim 18 wherein said scavenging tubes are connected to an inlet of said fan means.

* * * * *